United States Patent [19]

Kennedy

[11] 4,245,418

[45] Jan. 20, 1981

[54] MAGAZINE CATCH FOR FIREARMS

[75] Inventor: Ralph C. Kennedy, South Windsor, Conn.

[73] Assignee: High Standard, Inc., East Hartford, Conn.

[21] Appl. No.: 19,222

[22] Filed: Mar. 9, 1979

[51] Int. Cl.[3] ..... F41C 25/02

[52] U.S. Cl. ..... 42/7

[58] Field of Search ..... 42/7, 18, 22, 50

[56] References Cited

U.S. PATENT DOCUMENTS 3,372,506 3/1968 Wilhelm ..... 42/7

*Primary Examiner*—Charles T. Jordan

*Attorney, Agent, or Firm*—St. Onge, Steward, Johnston, Reens & Noë

[57] ABSTRACT

A magazine catch for firearms in which a latch member is spring urged into wedging engagement with a portion of the magazine to hold the magazine rigidly against a positioning stop on the frame of the firearm. The latch member consists of a latch pin having rollers for reducing friction when the magazine is inserted into place in the gun and a spring-loaded locking pin, which drives the latch pin into latching engagement with the magazine.

6 Claims, 5 Drawing Figures

Fig. 1.
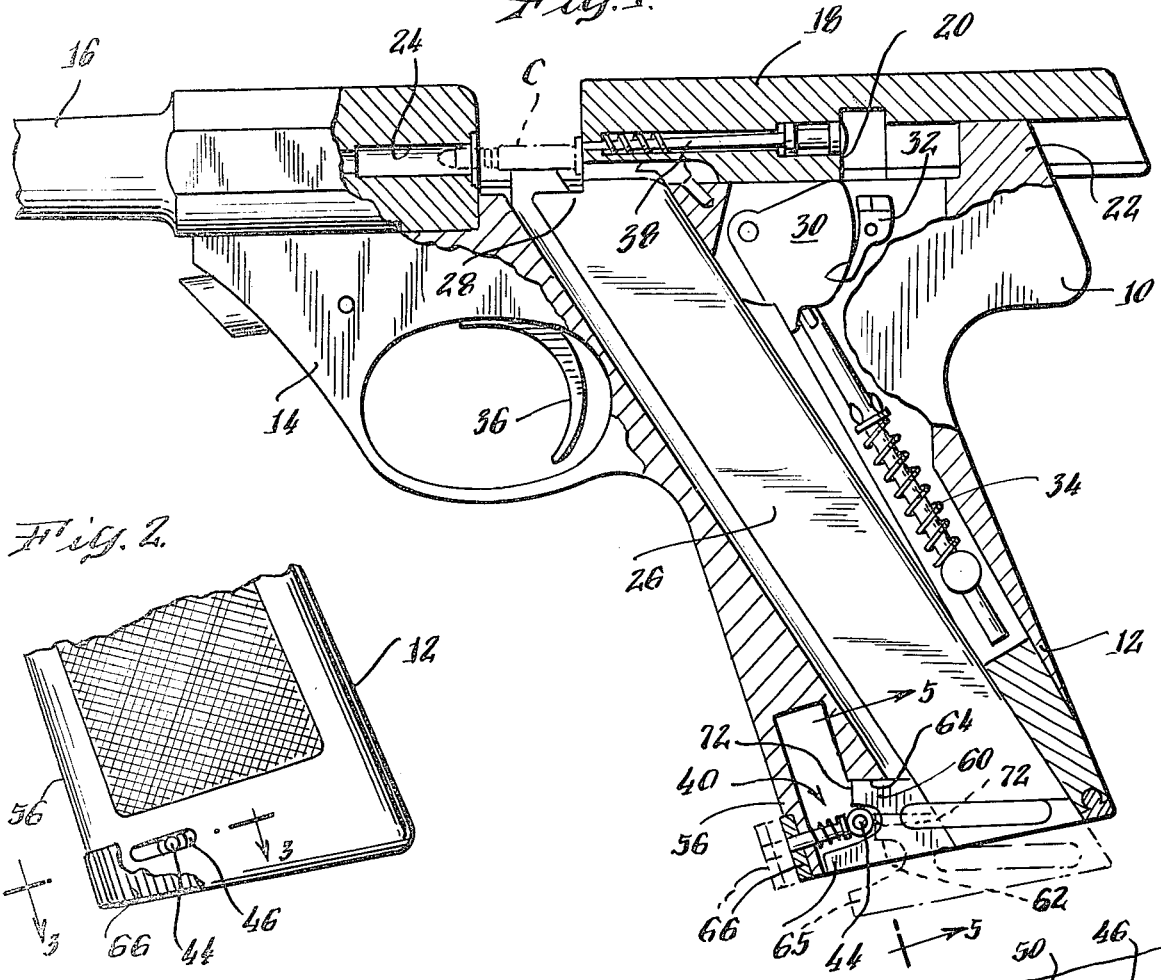
Fig. 2.
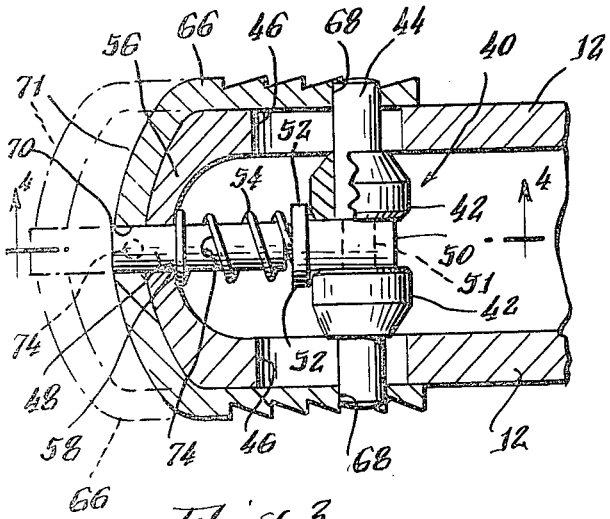
Fig. 3.
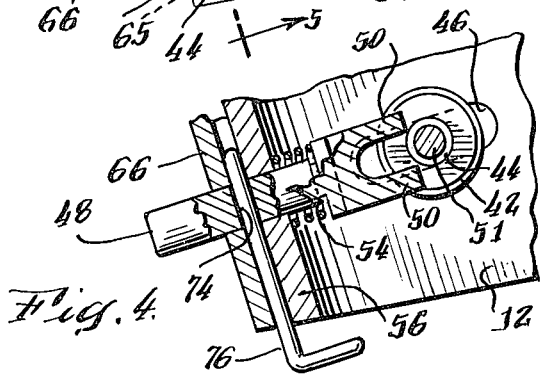
Fig. 4.
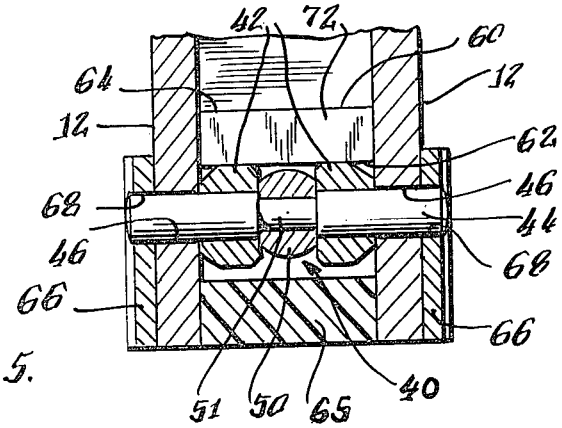
Fig. 5.

MAGAZINE CATCH FOR FIREARMS

BACKGROUND OF THE INVENTION

This invention relates to firearms, and it relates more particularly to an improved magazine catch for latching a removable magazine in position in the gun.

It is common practice to provide cartridge-holding lips or guide members at the open end of a magazine in order to guide the cartridges out of the magazine and into the chamber during the chambering operation. Nevertheless, malfunctions in reloading guns which employ this feature sometimes occur, especially in automatic or semi-automatic weapons, because the guide members on the magazine may not be properly positioned with respect to the cartridge chamber of the gun. Such misalignment is frequently due to the fact that it is difficult to hold manufacturing tolerances in the magazine catch, and/or in the magazine, close enough to prevent the guide members on the magazine from being too high or low with respect to the cartridge chamber. The cartridges therefore may not feed properly into the chamber and the gun becomes jammed.

An excellent magazine catch which overcomes this difficulty is disclosed in U.S. Pat. No. 3,372,506 to Wilhelm. In the Wilhelm catch, which has been used extensively for more than ten years on "High Standard" automatic pistols manufactured by applicant's assignee and its predecessors, the base plate of the magazine is constantly urged against a fixed portion of the frame of the pistol by a latch pin, which is driven at an angle against the underside of the magazine so that it wedges the base plate into solid engagement with a fixed portion of the frame, thereby precisely positioning the cartridge-guide members on the magazine.

An object of the present invention is to provide an improved magazine catch similar to that shown in Wilhelm U.S. Pat. No. 3,372,506, but in which the magazine can be inserted and removed more easily. Other objects of the invention are to reduce manufacturing costs, and to facilitate disassembly and reassembly of the catch, so that the owner of the gun can make any necessary repairs himself, instead of having to return the gun to the manufacturer or take it to a gunshop.

SUMMARY OF THE INVENTION

The invention resides in a magazine catch similar to that disclosed in the before-mentioned Wilhelm patent, in which the latch member includes a latch pin that is guided on the frame of the firearm so that it can be moved transversely of itself into wedging engagement with the cartridge magazine. However in accordance with the present invention, a locking pin is removably connected at one end to the latch pin in such a manner as to prevent the latch pin from moving longitudinally, the other end of the locking pin extending freely through an opening in the frame, so that it can slide longitudinally through the opening as the latch pin is moved transversely between its magazine-latching position and a retracted position in which the magazine is released. The locking pin is urged lengthwise by a spring into locking engagement with the latch pin to drive the latch member into wedging engagement with the magazine while at the same time preventing the latch member from being disassembled. This facilitates use of rollers on the latch pin which engage the magazine in order to reduce friction, which, in turn, greatly reduces the pressure required to latch the magazine in place and to release it.

These and other objects and advantages of the invention will become more readily apparent from the detailed description hereinafter of one embodiment of the invention which is illustrated in the accompanying drawings, wherein FIG. 1 is an elevational view of a pistol, portions being broken away and in longitudinal section to show a magazine catch embodying the invention;

FIG. 2 is an elevational view of only the lower end portion of the grip of the pistol shown in FIG. 1;

FIG. 3 is an enlarged section through the magazine catch taken on the line 3—3 of FIG. 2;

FIG. 4 is an enlarged section through the magazine catch taken on the line 4—4 of FIG. 3, but showing the catch in the process of being disassembled; and FIG. 5 is another enlarged section through the magazine catch taken on the line 5—5 of FIG. 1.

The firearm shown in the drawings purely for illustrative purposes is a semi-automatic pistol having a frame 10, which includes a grip 12 and a trigger guard 14. A barrel 16 is rigidly secured to the frame 10 above the trigger guard 14, and an action slide 18 reciprocates forward and back on guideways in the upper rear portion of frame 10. Slide 18 moves forwardly (to the left as shown in FIG. 1) into breech-closing engagement with the rear end of the barrel 16 and rearwardly to its retracted position where an inner shoulder 20 comes into abutment with a stop portion 22 at the rear of frame 10.

Silde 18 is shown in FIG. 1 partially open, as it is feeding a fresh cartridge C into the cartridge chamber 24 at the rear end of the bore in barrel 16. Cartridges are supplied by a removable magazine or clip 26 which fits into the grip 12 from the bottom thereof, the open upper end 28 of magazine 26 being located just below the cartridge chamber 24 when the magazine is in place in the gun, so that cartridges C may be fed into chamber 24 from the magazine by engagement of the face of slide 18 with the base of the top cartridge in the magazine as slide 18 moves forward from its retracted position.

Frame 10 is hollow inside with an elongated chamber extenting up through grip 12 in order to receive magazine 26. A pivoted hammer 30, sear 32 and hammer spring 34 are located in the rear portion of frame 10, while the trigger 36, which actuates sear 32 through a sear bar (not shown), is pivotally mounted within the trigger-guard 14. When slide 18 is moved forward by an action spring (not shown) into breech-closing position, hammer 30 can swing counterclockwise against the rear end of a firing pin 38 in slide 18 in order to fire a cartridge in the chamber.

Cartridges C are loaded into the open end 28 of magazine 26 against a spring-urged follower and are held therein by holddown lips which extend inwardly toward each other from opposite sides of the open end 28. The construction and operation of the pistol, and of the magazine, as described hereinabove, are old in the art, and no claim is made thereto per se.

The magazine catch of the present invention has a latch member, designated generally at 40, consisting of a pair of rollers 42, 42, which are freely rotatable on a latch pin 44 supported at its ends in slots 46, 46 in the opposite side walls of the grip 12. As best shown in FIG. 2, slots 46, 46 are elongated transversely of grip 12 such that latch-member 40 is constrained for movement transversely of magazine 26 into and out of latching relation therewith. Extending perpendicular to latch pin 44 is a locking pin 48, the inner end of which is bifurcated to form spaced fingers 50, 50 (FIGS. 3 and 4) that straddle the mid-section 51 of latch pin 44 intermediate the two rollers 42, 42. Flanges 52, 52 at the base of the fingers 50, 50 of the locking pin form an abutment against which one end of a compression spring 54 is compressed, the opposite end of spring 54 being seated against the inner side of an end wall 56 of grip 12, so that it urges locking pin 48 lengthwise into engagement with latch pin 44. The outer end of locking pin 48 extends freely through, and is guided in, a hole 58 in end wall 56.

When latch member 40 is moved out of its latching position with magazine 26, i.e. to the left as viewed in FIGS. 1–4, locking pin 48 moves longitudinally through the hole 58, as indicated in broken lines in FIG. 3. As will be noted in FIG. 5, the mid-section 51 of the latch pin 44 is reduced in diameter, and the fingers 50, 50 of locking pin 48 closely surround it so that they fit between the shoulders formed by the reduced section 51. Consequently, as long as the locking pin 48 is urged against the reduced section 51 of latch pin 44 by spring 54, pin 44 is prevented from moving longitudinally of itself. It will also be noted that the flanges 52, 52 on locking pin 48 must clear the rollers 42, 42, so that pin 48 can be urged against latch pin 44 without engaging the rollers, which should be free to rotate as the magazine 26 is moved from the broken-line position shown in FIG. 1 to its full-line position.

As in the case of the magazine catch of the aforementioned Wilhelm U.S. Pat. No. 3,372,506, the magazine 26 is provided at its base with a forwardly projecting latch portion 60, the underside 62 of which forms a latching surface for engagement by the latch member. In this case, rollers 42, 42 ride against the latching surface 62 to provide substantially frictionless moving engagement therewith. Under the pressure of spring 54, latch member 40 wedges the magazine upward, until the upper surface of the projection 60 engages a fixed stop surface 64 on the inside of grip 12 of the pistol. The magazine is thus positively positioned in the frame 10 of the pistol for proper positioning of its cartridge guide members with respect to the cartridge chamber. The base plate of the magazine also has a integrally formed projection 65 below the portion 60 for appearance purposes only.

A U-shaped finger-piece or yoke 66, like that for the magazine catch of the aforementioned Wilhelm patent, facilitates disengagement of latch member 40 for releasing the magazine. In this case, however, neither the latch pin 44 nor the locking pin 48 are rigidly fixed to yoke 66. Thus, both ends of latch pin 44 are freely received in holes 68, 68 in the legs of yoke 66, while the outer end of locking pin 48 fits freely through a hole 70 located in the central portion 71 of the yoke. Since locking pin 48 is urged by spring 54 into engagement with latch pin 44, it is supported at that end on the latch pin by the fingers 50, 50 which straddle the mid-section 51 of pin 44. The other end of locking pin 48 is supported in the hole 58 in frame 12. Likewise, as herein before mentioned, pin 44 is locked by pin 48 against movement lengthwise and therefore does not need to be rigidly fixed at its ends to the finger-piece or yoke, in order to prevent it from slipping out lengthwise. Since yoke 66 is supported at each end of its legs by the opposite ends of pin 44 and at the center by the outer end of pin 48, it moves in unison with pins 44 and 48, forming part of latch member 40. By grasping the outer ribbed sides of yoke 66 and moving it to the left as viewed in FIGS. 1–4, latch member 40 is moved bodily against the pressure of spring 54 to a retracted position shown in broken lines in FIGS. 1 and 3, in which rollers 42, 42 are free of the latch portion 60 on the base of the magazine 26, so that the magazine can be removed.

When a loaded magazine is re-inserted into the grip 12 of the firearm in the usual way, the front end 72 of its latch portion 60 engages rollers 42, 42 in the manner shown in broken lines in FIG. 1. By pressing the magazine upward, rollers 42, 42 roll against the surface 72, camming latch member 40 back against the pressure of spring 54. As the base portion 60 of the magazine rides over rollers 42, 42, latch member 40 immediately snaps back to its latching position, where rollers 42, 42 ride against the underside 62 of base portion 60 urging it upward into engagement with the stop surface 64.

It will be noted that, as in the case of the magazine catch shown in Wilhelm U.S. Pat. No. 3,372,506, the guide slots 46, 46 in the side walls of grip 12 are inclined relative to the surface 62 of the base of the magazine such that as the latch member 40 is urged by its spring 54 toward its latching position, rollers 42, 42 cam the magazine tightly against the stop surface 64. Since rollers 42, 42 reduce the friction between the latch member 40 and the surface 62, the magazine is pressed even more firmly against the surface 64 than in the Wilhelm magazine catch. On the other hand, the force required to move the latch member 40 back to its retracted position is reduced by the rolling action of rollers 42, 42.

Still more important, however, is the fact that when the magazine is being re-inserted, the action of rollers 42, 42 against the surface 72 on the base 60 greatly reduces the pressure required to cam the latch member 40 out of the way until the magazine is fully in place. The action of the magazine catch is thereby made substantially smoother both in latching and releasing the magazine.

As shown in FIG. 3, locking pin 48 is provided with a hole 74 extending transversely through it for use in assembling and disassembling the latch member 40. By moving the latch member 40 manually to its fully retracted position, as indicated by the broken-line showing of yoke 66 and locking pin 48, the hole 74 is disposed outward of the end wall 56 of the grip 12. An assembly pin 76 (FIG. 4) may then be inserted between yoke 66 and end wall 56 into the hole 74 of the locking pin 48, in order to retain locking pin 48 in the broken-line position of FIG. 3. However, the latch pin 44 is then free to be moved to the right as shown in FIG. 4 out of engagement with locking pin 48, where it is no longer trapped against longitudinal movement by the fingers 50, 50, so that it can be driven endwise through one of the holes 68, 68 in the yoke 66. Yoke 66 is then free to be removed off the end of pin 48, while spring 54 and pin 48 remain pinned to the end wall 56 of grip 12 by means of assembly pin 76. Removal of latch pin 44 also releases rollers 42, 42, so that they can be cleaned or replaced, if necessary. Removal of the assembly pin 76 from the hole 74 in locking pin 48 then results in complete disassembly of the latch member. Re-assembly is accomplished by simply reversing the steps taken in disassembling the unit.

An important advantage of the present invention is that during manufacture of the firearm, the initial assembly of the magazine catch is substantially less expensive than assembly of the prior catch shown in the above-mentioned Wilhelm patent. This is due primarily to the fact that in the Wilhelm catch it is necessary to stake the latch pin to the yoke or finger-piece in order to prevent it from being dislodged. Such an operation is difficult to accomplish without bending the yoke and causing it to bind against the frame, so that the catch can not function properly. It has been found, moreover, that total manufacturing costs for both material and labor for the magazine catch of the present invention is only about one-third as much as for the previous catch shown in the above-mentioned Wilhelm patent. This results in a 6% reduction in labor and material for the entire pistol. Such cost reduction is achieved even with the addition of the friction-reducing rollers. Moreover, the ease of disassembly and re-assembly makes it readily feasible for the gun-owner to make repairs or replace parts himself, instead of returning the gun to the manufacturer or to a gunsmith to be reworked.

In addition to the foregoing advantages, the magazine catch of the present invention works much more smoothly and with considerably less effort, both in releasing the magazine and when re-inserting it into the gun.

What is claimed is:

1. In a firearm having a frame including substantially parallel side walls and an end wall, a cartridge magazine detachably mounted between the side walls of said frame for storing cartridges and delivering them to a position for chambering, said frame having a magazine-positioning stop, and a magazine catch for detachably securing the magazine against said positioning stop, said catch having a latch member mounted on said frame for movement into wedging engagement with said magazine and spring means for urging said latch member into such wedging engagement, the improvement in said magazine catch wherein said latch member comprises a latch pin guided on said frame for movement transversely of itself from a retracted position to a latching position, a pair of rollers rotatably mounted on said latch pin for engagement with said magazine when said latch pin is moved to said latching position, and a locking pin supported independent of said latch pin, one end of said locking pin extending through a hole in the end wall of said frame, and said locking pin being urged longitudinally by said spring means into locking engagement at its other end with said latch pin.

2. A magazine catch as defined in claim 1, wherein said latch pin is guided adjacent its ends in slots in said side walls of said frame, and each of said rollers is confined lengthwise of said latch pin between said locking pin and the adjacent side wall of the frame.

3. A magazine catch as defined in claim 2, wherein said latch pin is reduced in diameter intermediate said rollers, said other end of said locking pin being bifurcated to form spaced fingers capable of straddling said reduced section of said latch pin, the space between said fingers being less than the diameter of said latch pin adjacent said reduced section, thereby locking said latch pin against movement longitudinally of itself.

4. A magazine catch as defined in claim 3, wherein said latch member further includes a yoke having spaced legs straddling the slotted side walls of said frame for manually moving said latch pin to its retracted position against the pressure of said spring means, the ends of said latch pin extending outwardly through said slots for connection with said yoke, said yoke having a hole in each of its legs for freely receiving the ends of said latch pin and having a central opening aligned with said opening in said frame, said one end of said locking pin extending freely into said central opening in said yoke, such that said yoke is supported by and movable with said latch and locking pins as a unit.

5. A magazine catch as defined in claim 4, in which said locking pin is provided with a transverse assembly-hole located along its length such that when said latch member is moved to said retracted position, said assembly hole is exposed outward of the endwall of said frame in order to receive an assembly-pin for preventing movement of said locking pin from its retracted position, thereby permitting separation of said latch pin and rollers from said locking pin on movement of said latch pin toward its latching position and releasing said latch pin for longitudinal movement through said slots in said frame and through said holes in the legs of said yoke in order to disassemble and re-assemble said latch member.

6. In a firearm having a frame including substantially parallel side walls and an end wall, a cartridge magazine detachably mounted between said side walls for storing cartridges and delivering them to a position for chambering, a magazine catch for detachably securing the magazine against a positioning stop on said frame, said catch having a latch member supported by said frame for movement into wedging engagement with said magazine, and spring means for urging said latch member into such wedging engagement, the improvement in said magazine catch wherein said latch member comprises, a latch pin guided on said frame for movement transversely of itself from a retracted position to a latching position, said latch pin being reduced in diameter at its mid-section, a locking pin supported adjacent one end in a hole in the end wall of said frame and urged longitudinally by said spring means into engagement at its other end with said latch pin, said other end of said locking pin being bifurcated to form spaced fingers capable of straddling said reduced mid-section of said latch pin, the space between said fingers being less than the diameter of said latch pin adjacent said reduced section, thereby locking said latch pin against movement longitudinally of itself, and a yoke having spaced legs which straddle said side walls of said frame for manually moving said latch pin to its retracted position against the pressure of said spring means, said legs having aligned holes for freely receiving the ends of said latch pin, said yoke having a central opening to receive said locking pin, said one end of said locking pin extending freely into said central opening in said yoke, such that said yoke is supported by and movable with said latch and locking pins as a unit.

* * * * *